United States Patent [19]

Luhman et al.

[11] 4,431,862

[45] Feb. 14, 1984

[54] MULTIWIRE CONDUCTOR HAVING INCREASED INTERWIRE RESISTANCE AND GOOD MECHANICAL STABILITY AND METHOD FOR MAKING SAME

[75] Inventors: Thomas Luhman, Seattle, Wash.; Carl Klamut, East Patchogue, N.Y.

[73] Assignee: The United States of America as represented by the United States Department of Energy, Washington, D.C.

[21] Appl. No.: 358,083

[22] Filed: Mar. 15, 1982

[51] Int. Cl.[3] ..... H01B 7/08; H01B 12/00

[52] U.S. Cl. ..... 174/128 R; 29/599; 29/82. 29/825; 156/50; 156/155; 174/126 S; 174/128 S; 228/200; 335/216; 428/613; 428/614; 428/930

[58] Field of Search ..... 174/15 S, 126 S, 128 S, 174/129 S; 335/216; 228/200; 428/900; 156/50, 156/155; 29/599, 825

[56] References Cited

U.S. PATENT DOCUMENTS

| | | | |
|---|---|---|---|
| 3,184,303 | 5/1965 | Grobin, Jr. | 29/599 |
| 3,472,944 | 10/1969 | Morton et al. | 174/126 S |
| 3,548,078 | 12/1970 | Albrecht | 335/216 X |
| 3,638,154 | 1/1972 | Sampson | 174/126 S X |
| 3,954,572 | 5/1976 | Ziegler | 29/599 X |
| 4,079,187 | 3/1978 | Fillunger | 174/126 S |
| 4,161,062 | 7/1979 | Agatsuma et al. | 29/599 |

FOREIGN PATENT DOCUMENTS 2626384 12/1977 Fed. Rep. of Germany ... 174/128 S

OTHER PUBLICATIONS

Accelerator Superconducting Magnets Give Headaches; Physics Today; Apr. 1981, pp. 17–20.

A Productive Collaboration; Brookhaven Bulletin; vol. 35, No. 12; Mar. 27, 1981.

*Primary Examiner*—A. T. Grimley

*Assistant Examiner*—Morris H. Nimmo

*Attorney, Agent, or Firm*—Robert H. Whisker; Paul A. Gottlieb; Richard G. Besha

[57] ABSTRACT

An improved multiwire conductor of the type which is mechanically stabilized by a solder filler. A solder filled conductor is heated to a temperature sufficient to make the solder brittle, but below the melting point of the solder. While still hot, the conductor is flexed, causing the solder to separate from the wires comprising the conductor, thereby increasing the interwire resistance. In one embodiment the conductor may be heated to a temperature above the eutectic temperature of the solder so that a controlled amount of solder is removed. The subject invention is particularly suited for use with braided, ribbon-type, solder filled superconductors.

10 Claims, 5 Drawing Figures

MULTIWIRE CONDUCTOR HAVING INCREASED INTERWIRE RESISTANCE AND GOOD MECHANICAL STABILITY AND METHOD FOR MAKING SAME

BACKGROUND OF THE INVENTION

The United States Government has rights in this invention pursuant to Contract No. De-AC02-76CH00016, between the U.S. Department of Energy and Associated Universities, Inc.

This invention relates to multiwire conductors, and more particularly to a braided ribbon-type superconductor having low eddy current losses, and to a method for manufacturing such superconductor.

In superconducting magnets of the type used in high energy particle accelerators the use of high aspect ratio, solder filled, braided superconductor has been proposed. (See Physics Today, April 1981, pg. 17). Superconducting wires were braided to form a ribbon-type conductor, substantially as described in U.S. Pat. No. 3,638,154 to Sampson, et al., issued Jan. 25, 1972. The interstices of the braid were then filled with a solder, typically a nominal 97 weight % Sn, 3 weight % Ag solder, in order to provide stiffness and mechanical stability to the ribbon.

While the solder provided mechanical stability, it also provided a path for eddy currents which sometimes caused unacceptable losses in magnets made with such braided superconductor. This problem was particularly difficult to deal with, since eddy current losses varied from magnet to magnet and at that time the reasons for these variations were unknown.

Examination of samples of superconductors used in prototype magnets disclosed cracks in the solder and this led to the hypothesis that low eddy current losses were related to the formation of cracks in the solder. Based on this hypothesis, efforts were made to develop methods for producing controlled cracking of the solder. As a result of these efforts, two separate methods were developed. One method, conceived by T. Luhman and M. Suenage, is the subject of a separate, currently pending, commonly assigned application, and has as its object the production of a ribbon-type superconductor having a greatly increased interwire resistance so as to greatly reduce eddy current losses in the superconductor. This method, however, is only suitable for use with tin based solders.

The second method, which is the subject of the instant application, has as its object to provide a method for producing a braided, ribbon-type superconductor which has a moderately increased interwise resistance and retains substantial mechanical stability.

It is also an object of the subject invention to provide a method for producing braided, ribbon-type superconductors which may be used with both tin and lead-based solders.

SUMMARY OF THE INVENTION

The above described objects are achieved, and the disadvantages of the prior art are overcome by heating a multiwire conductor of the type which is mechanically stabilized by a solder filler to a temperature below the melting point of the solder, but sufficient to produce what is commonly referred to as the "hot-short" phenomenon. The superconductor is then flexed at that temperature so as to cause separation of the solder from the wires at the wire/solder interface.

In one embodiment of the subject invention the temperature is chosen to be above the eutectic temperature so that a controlled fraction of solder may be melted out of the superconductor before it is flexed.

(The "hot-short" phenomenon is a well known metallurgical phenomenon in which normally ductile materials become brittle at elevated temperatures. The eutectic temperature of an alloy is the temperature at which localized melting begins to occur so that the alloy become a two-phase mixture. As the temperature increases above the eutectic temperature, the liquid phase increases, reaching 100% at the melting temperature).

Since the cracking occurs only at the interface in the subject invention, it is advantageously found that upon cooling the wires remain locked in the solder matrix, so that substantial stiffness and mechanical stability are retained by the superconductor.

Further, the method of the subject invention may be used with both tin and lead-based solders, since both types of solder exhibit the "hot-short" phenomenon.

Other objects and advantages of the subject invention will be apparent from a consideration of the attached drawings, and the detailed description set forth below.

DETAILED DESCRIPTION OF THE INVENTION

Figure 1:
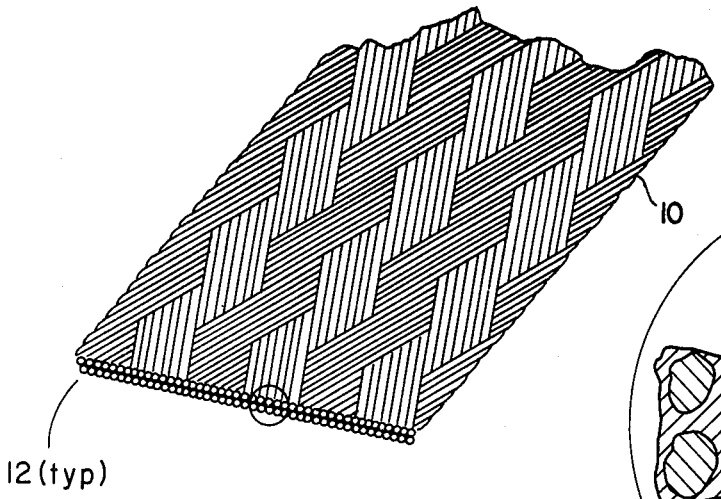
Fig. 1 PRIOR ART
FIG. 1 is an isometric view of a segment of a braided ribbon-type superconductor of the type used in the subject invention.
Figure 2:
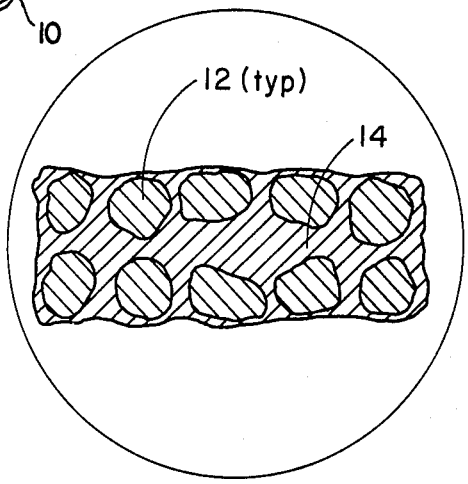
Fig. 2 PRIOR ART
FIG. 2 is a partial cross-section of such a superconductor manufactured in accordance with the prior art.

Turning to FIGS. 1 and 2, a braided, ribbon-type superconductor 10 is formed by braiding superconducting wires 12 by conventional means. These wires 12 are typically multifilimentary wires formed by coextrusion and drawing of a niobium-titanium and copper composite. A more detailed understanding of the manufacture and properties of superconducting wires is not believed necessary for an understanding of the subject invention.

For mechanical stability, the superconductor is then filled with solder 14 by immersion in a solder bath. Solder 14 is preferably a 97 weight % Sn, 3 weight % Ag (nominal) alloy.

As may be seen in FIG. 2, solder 14 is typically in intimate contact with wire 12, though some uncontrolled cracking and separation of the solder may be caused by processing of the superconductor after it is removed from the solder bath. Because of this intimate contact between wires 12 and solder 14, eddy currents are easily induced in the solder by changes in the current in wires 12 leading to unacceptably high ac losses in the superconductor.

These losses may be eliminated in accordance with the subject invention by using the "hot-short" phenomenon found in certain alloys such as tin and lead-based solders to cause controlled cracking of solder 14 away from wires 12.

In accordance with the subject invention, the solder-filled superconductor 10 is immersed in a salt bath and heated to a temperature sufficient to raise superconductor 10 to a temperature sufficiently high to cause "hot-shortness" in the solder, but below the melting temperature of the solder. For a typical 97 weight % Sn, 3 weight % Ag solder this temperature would be in the approximate range of 170°–220° C. After superconductor 10 has been immersed for a time sufficient for uniform heating, it is flexed or otherwise mechanically worked to cause cracking at the solder/wire interface 16. Preferably, the flexing may be carried out by passing superconductor 10 through one or more "crown" rollers. ("Crown" rollers are well known to those skilled in the art of cable manufacture and need not be described further for an understanding of the present invention.)

Figure 3:
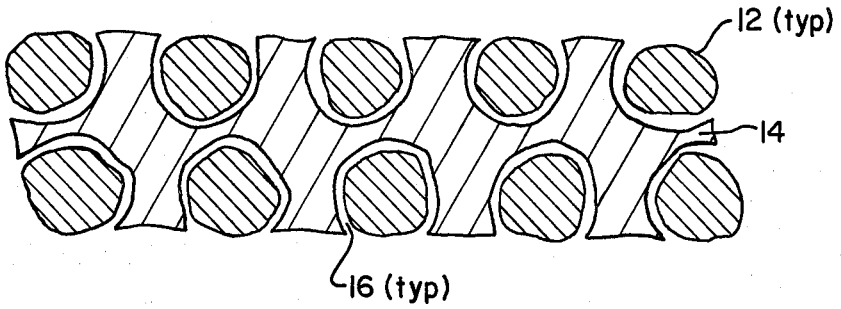
FIG. 3 is a partial cross-section of such a superconductor manufactured in accordance with the method of the subject invention in an embodiment when the superconductor is treated at a temperature below the eutectic temperature of the solder.

In one embodiment of the subject invention, superconductor 10 is treated at a temperature below the eutectic temperature of the solder. As is shown in FIG. 3, treatment at a temperature below the eutectic temperature of the solder causes controlled cracking at interface 16 without substantial loss of solder 14. Thus, after cooling wires 12 remain mechanically locked into the matrix of solder 14 so that the mechanical stability of superconductor 10 is substantially unaffected while the separation at interface 16 substantially reduces the ac losses.

Figure 4:
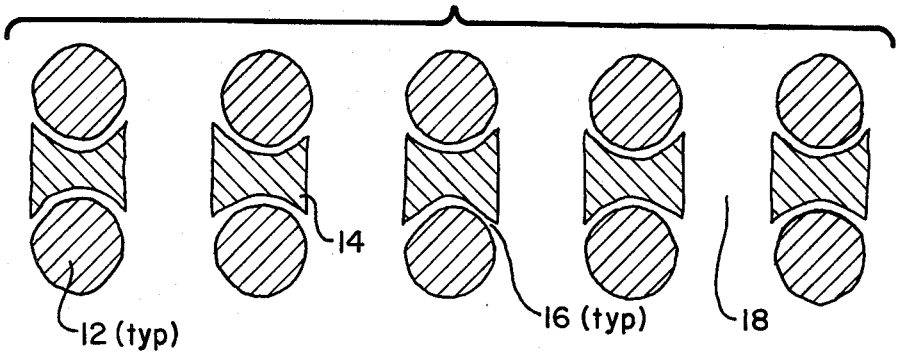
FIG. 4 is a partial cross-section of such a superconductor manufactured in accordance with the method of the subject invention in an embodiment where the superconductor is treated at a temperature above the eutectic temperature of the solder.

In another embodiment of the subject invention superconductor 10 is heated to a temperature above the eutectic temperature. As is shown in FIG. 4, treatment at a temperature above the eutectic temperature produces both a controlled cracking at interface 16, and a controlled loss of solder 14, leaving voids 18. This results in a further increase in the inter-wire resistance at the price of some loss of mechanical stability.

The amount of solder 14 lost in this embodiment will depend on the particular structure of the superconductor braid and the type of solder 14 used and may be controlled by the temperature chosen and the time superconductor 10 remains in the salt bath. Precise relationships between time and temperature and the amount of solder 14 lost may best be determined by routine experimentation.

EXPERIMENTAL EXAMPLES

A series of short samples of superconducting braid were heat treated in a salt bath for periods of approximately 1½ minutes at temperatures ranging from 170° C. to 220° C. The superconductor was filled with a 97 weight % Sn, 3 weight % Ag solder, having a eutectic temperature of 221° C.

Figure 5:
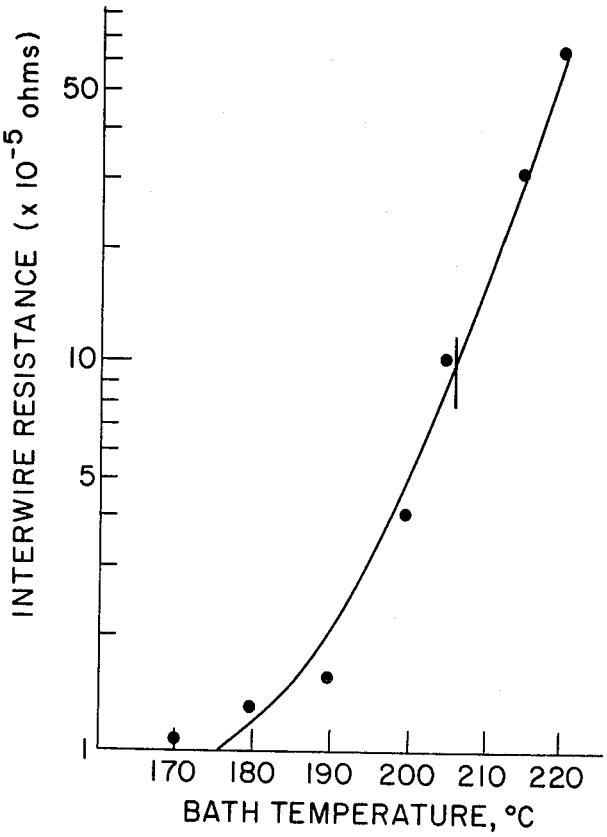
FIG. 5 is a plot of inter-wire resistance versus processing temperature of a superconductor manufactured in accordance with the method of the subject invention in the embodiment where the superconductor is treated at a temperature below the eutectic temperature of the solder.

After heating, the samples were manually flexed without cooling. After cooling the inter-wire resistance was measured. The results obtained are plotted in FIG. 5. For comparison it should be noted that the inter-wire resistance for untreated superconductor is the order of $0.5\times10^{-5}$ ohms when measured under the same conditions.

The above examples and drawings and description are set forth by way of illustration only, and other embodiments of the subject invention will be readily apparent to those skilled in the art. In particular, it should be noted that it is within the contemplation of the subject invention to apply the method of the subject invention to configurations of conductors other than braided superconductors where those configurations are made mechanically stable by a solder filler, and it is desired to increase the inter-wire resistance without excessively reducing the mechanical stability. Thus, limitations on the subject invention are to be found only in the claims set forth below.

We claim:

1. A method for increasing the inter-wire resistance of a multi-wire conductor of the type which is mechanically stabilized by a solder filler, comprising the steps of:

(a) heating the conductor to a uniform temperature which is sufficient to cause the "hot-short" phenomena in the solder, but which is below the melting temperature of the solder; and (b) flexing the conductor without cooling so that said solder separates from said wires at the solder/wire interface.

2. The method of claim 1, wherein said temperature is below the eutectic temperature.

3. The method of claim 1, wherein said temperature is above the eutectic temperature, so that a controlled amount of solder is lost.

4. The methods of claims 1, 2, or 3, wherein said conductor is a braided, ribbon-type conductor.

5. The method of claim 4, wherein said conductor is a superconductor.

6. A multiwire conductor of the type which is mechanically stabilized by a solder filler which is produced by:

(a) heating the conductor to a uniform temperature which is sufficient to cause the "hot-short" phenomena in the solder, but which is below the melting temperature of the solder; and (b) flexing the conductor without cooling so that said solder separates from the wires of the multiwire conductor at the solder/wire interface, thereby increasing the interwire resistance of said conductor.

7. The conductor of claim 6, wherein the temperature to which said conductor is heated is below the eutectic temperature.

8. The conductor of claim 6, wherein the temperature to which said conductor is heated is above the eutectic temperature, so that a controlled amount of solder is lost.

9. The conductor of claim 6, wherein the conductor is a braided, ribbon-type conductor.

10. The conductor of claim 6, wherein the conductor is a superconductor.

* * * * *